US010591196B2

(12) United States Patent
Qi et al.

(10) Patent No.: US 10,591,196 B2
(45) Date of Patent: Mar. 17, 2020

(54) REFRIGERATOR CONTROL METHOD AND SYSTEM USING LINEAR COMPRESSOR

(71) Applicant: QINGDAO HAIER JOINT STOCK CO., LTD., Qingdao, Shandong Province (CN)

(72) Inventors: Feifei Qi, Qingdao (CN); Xiaobing Zhu, Qingdao (CN); Jianru Liu, Qingdao (CN); Lisheng Ji, Qingdao (CN); Shufeng Zhang, Qingdao (CN)

(73) Assignee: QINGDAO HAIER JOINT STOCK CO., LTD, Qingdao, Shandong Province (CN)

( * ) Notice: Subject to any disclaimer, the term of this patent is extended or adjusted under 35 U.S.C. 154(b) by 93 days.

(21) Appl. No.: 15/750,501

(22) PCT Filed: Aug. 15, 2016

(86) PCT No.: PCT/CN2016/095269
§ 371 (c)(1),
(2) Date: Feb. 5, 2018

(87) PCT Pub. No.: WO2017/076099
PCT Pub. Date: May 11, 2017

(65) Prior Publication Data

US 2018/0216861 A1 Aug. 2, 2018

(30) Foreign Application Priority Data

Nov. 5, 2015 (CN) ..... 2015 1 0747235

(51) Int. Cl.
*F04B 35/04* (2006.01)
*F25D 29/00* (2006.01)
(Continued)

(52) U.S. Cl.
CPC ..... *F25B 49/022* (2013.01); *F04B 35/04* (2013.01); *F04B 49/065* (2013.01); *F04B 49/12* (2013.01);
(Continued)

(58) Field of Classification Search
CPC F25B 49/022; F25B 31/023; F25B 2400/073; F25B 2500/31;
(Continued)

(56) References Cited

U.S. PATENT DOCUMENTS

| | | | | |
|---|---|---|---|---|
| 4,179,899 | A | 12/1979 | Katayama | |
| 2004/0101413 | A1 | 5/2004 | Inagaki et al. | |
| 2018/0010847 | A1* | 1/2018 | Qi | F04B 35/04 |

FOREIGN PATENT DOCUMENTS

| | | | |
|---|---|---|---|
| CN | 1657777 | A | 8/2005 |
| CN | 103069163 | A | 4/2013 |

(Continued)

*Primary Examiner* — Marc E Norman
(74) *Attorney, Agent, or Firm* — Cheng-Ju Chiang

(57) ABSTRACT

The present invention discloses a refrigerator control method and system using a linear compressor. The control method comprises: monitoring an ambient temperature T of a refrigerator; comparing the ambient temperature T with a preset ambient temperature threshold T0; if T is greater than T0, controlling an output power of the linear compressor to be a preset first output power, and if T is smaller than or equal to T0, controlling the output power of the linear compressor to be a preset second output power, which is greater than the preset first output power. In the present invention, by increasing the stroke of the piston inside the linear compressor through controlling the output power of the linear compressor, the refrigerator can be guaranteed to work normally by avoiding protection of the linear compressor by the frequency converting board.

8 Claims, 3 Drawing Sheets

(51) Int. Cl.

| | |
|---|---|
| ***F25B 49/02*** | (2006.01) |
| ***F04B 49/06*** | (2006.01) |
| ***F04B 49/12*** | (2006.01) |
| *F25B 31/02* | (2006.01) |

(52) U.S. Cl.
CPC ..... *F25D 29/00* (2013.01); *F04B 35/045* (2013.01); *F25B 31/023* (2013.01); *F25B 2400/073* (2013.01); *F25B 2500/31* (2013.01); *F25B 2700/2106* (2013.01)

(58) Field of Classification Search
CPC .. F25B 2700/2106; F04B 35/04; F04B 49/05; F04B 49/12; F25D 29/00
See application file for complete search history.

(56) References Cited

FOREIGN PATENT DOCUMENTS

| | | | |
|---|---|---|---|
| CN | 103352825 | A | 10/2013 |
| CN | 203394701 | U | 1/2014 |
| CN | 105241172 | A | 1/2016 |

* cited by examiner

REFRIGERATOR CONTROL METHOD AND SYSTEM USING LINEAR COMPRESSOR

CROSS REFERENCE TO RELATED APPLICATIONS

The present application is a 35 U.S.C. § 371 National Phase conversion of International (PCT) Patent Application No. PCT/CN2016/095269, filed on Aug. 15, 2016, which further claims benefit of Chinese Patent Application No. 201510747235.1, filed on Nov. 5, 2015, the disclosure of which is incorporated by reference herein. The PCT International Patent Application was filed and published in Chinese.

TECHNICAL FIELD

The present invention is related to the field of refrigerators and linear compression technologies, and more particularly to a refrigerator control method and system using a linear compressor.

BACKGROUND

A compressor, which is a driven fluid machine that converts low-pressure air into high-pressure air, is the heart of a cooling system. It sucks low-temperature and low-pressure coolant air from an air sucking pipe, compresses the coolant air using a piston driven by an electric motor, and discharges high-temperature and high-pressure coolant air to an air discharging pipe, thereby providing driving power for a cooling cycle and realizing the cooling cycle including compression→condensing (heat radiating)→expanding→evaporating (heat absorbing) steps.

Linear compressors are widely used in small cooling output fields such as refrigerators, and have the advantages of simple structures, less frictional losses, low noise, convenient adjustment of flow rates by adjusting the voltages, enhanced simplicity and reliability compared with frequency converting adjustments and application of lubricants including less or no grease. For example, the Chinese patent CN 203394701U discloses a linear compressor. As shown in FIG. 1, the linear compressor includes an air discharging mechanism 1 and a compressor assembly. The compressor assembly includes a cylinder 16, a piston assembly, a movable-magnet type linear oscillating motor, a resonance spring 8 and a compressor housing. The piston assembly includes a piston 2, a piston rod 3, a rod end plate 10 and an air sucking valve 15. The air discharging mechanism 1 includes an air discharging valve sheet 17, and an air discharging valve plate 18 etc.

The working process of the linear compressor is electronically controlled. When the output power is relatively small, as the stroke of the piston 2 of the linear compressor is relatively small, the piston 2 can easily collide with the air discharging valve plate 18, causing failure of the compressor. Thus, when designing the frequency converting board of a linear compressor, a protection program will be set to prevent damages to the mechanical members of the compressor. For example, the frequency converting board of the linear compressor will activate the protection program to stop the linear compressor.

When a refrigerator works at low temperatures, the thermal load of the refrigerator is relatively low, and the cooling output required by the compartments is relatively low. At this time, the linear compressor will operate at a relatively low output power. As a result, the stroke of the piston of the linear compressor is relatively small, and there is a risk of collision between the piston and the air discharging valve plate.

SUMMARY

The technical problem to be solved by the present invention is to overcome the shortcomings of the prior arts by providing a refrigerator control method and system using a linear compressor.

To solve the above technical problem, the present invention is realized through the following technical solutions.

A refrigerator control method using a linear compressor comprises: monitoring an ambient temperature T of a refrigerator; comparing the ambient temperature T with a preset ambient temperature threshold T0; if T is greater than T0, controlling an output power of the linear compressor to be a preset first output power, and if T is smaller than or equal to T0, controlling the output power of the linear compressor to be a preset second output power, which is greater than the preset first output power.

As an improvement of the present invention, the method further comprises: monitoring an operation state of the linear compressor; when the operation state of the linear compressor is abnormal, increasing by a predetermined value to the second output power; when the operation state of the linear compressor becomes normal, updating the second output power with the current output power.

As a further improvement of the present invention, the method further comprises: monitoring an operation state of the linear compressor; when the operation state of the linear compressor is abnormal, increasing by a predetermined value to the current output power, and setting the increased output power as a third output power; when the operation state of the linear compressor becomes normal, associating the third output power with the ambient temperature T, and when the ambient temperature is smaller than or equal to T, activating the linear compressor at the third output power.

As a yet further improvement of the present invention, monitoring the operation state of the linear compressor comprises: judging if the linear compressor stops by accident when operating within a predetermined period; if yes, regarding the operation state of the linear compressor as an abnormality.

As a yet further improvement of the present invention, the operation period of the linear compressor under the first output power is longer than that of the linear compressor under the second output power.

Correspondingly, a refrigerator control system using a linear compressor is provided, the control system comprising a temperature sensor and a main control board connected with the temperature sensor, wherein the temperature sensor is configured to monitor an ambient temperature T of a refrigerator; the main control board is configured to compare the ambient temperature T with a preset ambient temperature threshold T0; and the main control board is further configured to control an output power of the linear compressor, control the output power of the linear compressor to be a preset first output power if T is greater than T0, and control the output power of the linear compressor to be a preset second output power which is greater than the preset first output power if T is smaller than or equal to T0.

As an improvement of the present invention, the main control board is further configured to monitor an operation state of the linear compressor, increase by a predetermined value to the second output power when the operation state of the linear compressor is abnormal, and update the second output power with the current output power when the operation state of the linear compressor becomes normal.

As a further improvement of the present invention, the main control board is further configured to monitor an operation state of the linear compressor, increase by a predetermined value to the current output power and set the increased output power as a third output power when the operation state of the linear compressor is abnormal, associate the third output power with the ambient temperature T when the operation state of the linear compressor becomes normal, and activate the linear compressor at the third output power when the ambient temperature is smaller than or equal to T.

As a yet further improvement of the present invention, the main control board is further configured to: judge if the linear compressor stops by accident when operating within a predetermined period; if yes, regard the operation state of the linear compressor as an abnormality.

As a yet further improvement of the present invention, the main control board is further configured to control the operation period of the linear compressor under the first output power to be longer than that of the linear compressor under the second output power.

The present invention may produce the following advantageous effects. As can be seen from the above technical solutions, by increasing the stroke of the piston inside the linear compressor through controlling the output power of the linear compressor, the refrigerator can be guaranteed to work normally by avoiding protection of the linear compressor by the frequency converting board.

DETAILED DESCRIPTION

To make the objects, technical solutions and advantages of the present invention clearer, the embodiments of the present invention are described in detail with reference to the accompanying drawings. Examples of these preferred embodiments are given in the accompanying drawings. The embodiments of the present invention shown in the accompanying drawings and described based on the accompanying drawings are only exemplary and are not intended to limit the present invention.

In addition, it should be noted that in order not to obscure the present invention by unnecessary details, the accompanying drawings only show the structures and/or processing steps closely related with the technical solutions of the present invention, while other details not closely related therewith are omitted.

Further, it should be noted that the terms "comprise", "include" or other variants intend to include the listed elements in an non-exclusive manner, so that the processes, methods, objects or devices including a series of elements not only include such elements but also include other elements not clearly listed, or the inherent elements of such processes, methods, objects or devices.

Figure 1:
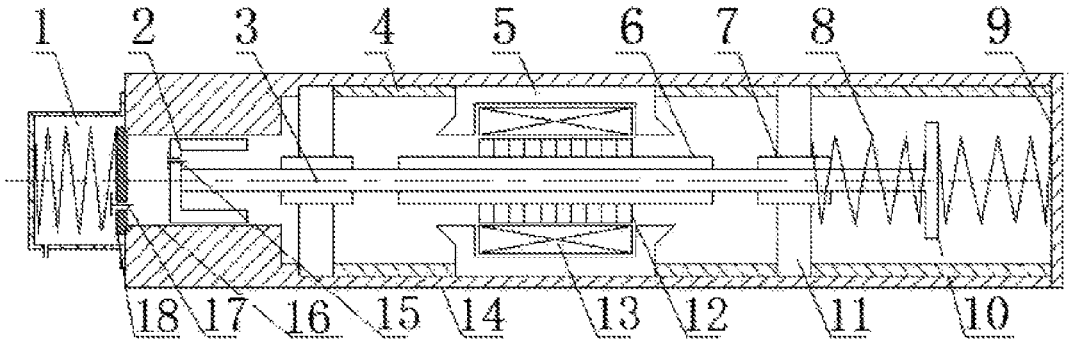
Fig. 1 (Prior Art)
FIG. 1 is a schematic view of a linear compressor in the prior arts.
Figure 2:
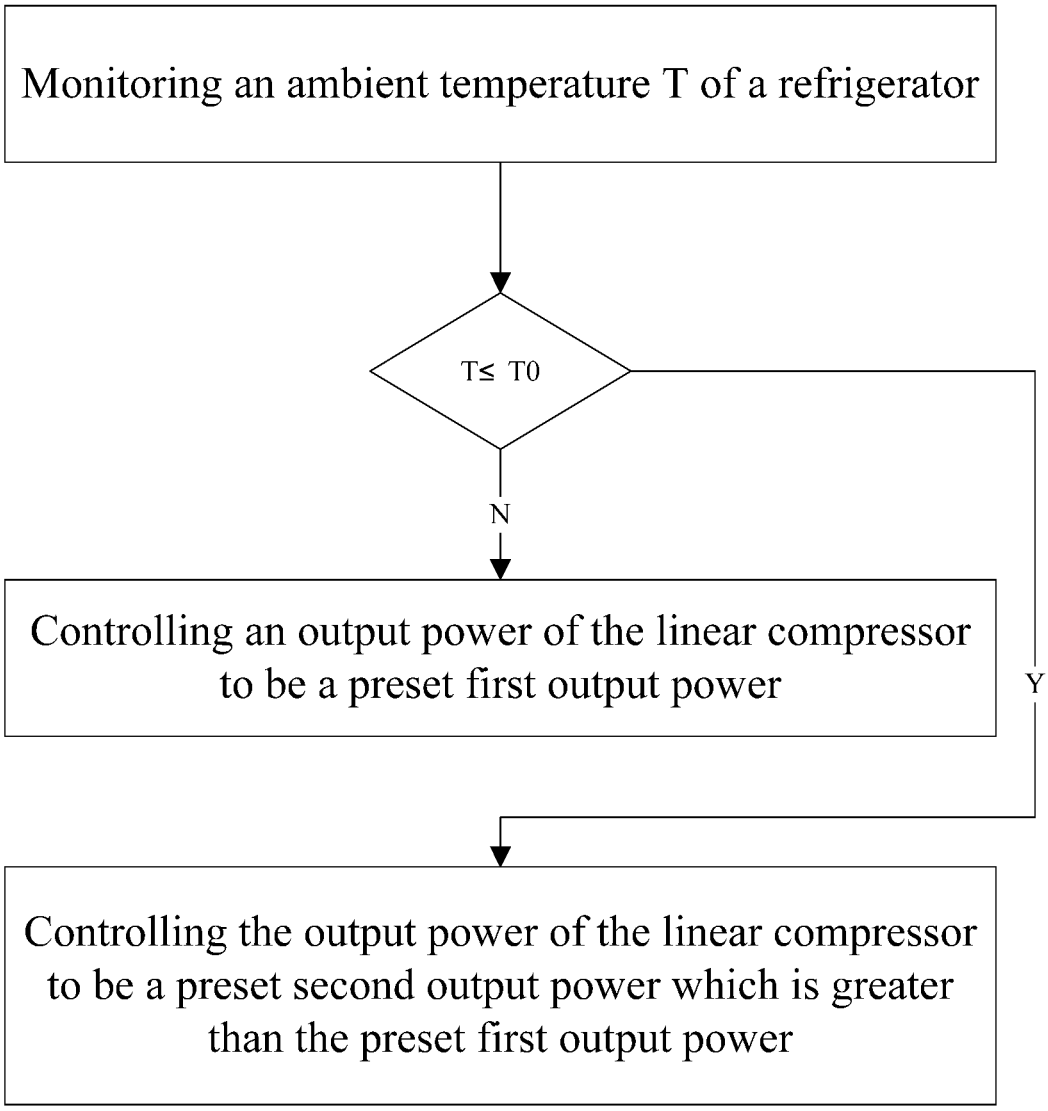
FIG. 2 is a flow chart of a refrigerator control method according to a first embodiment of the present invention.

As shown in FIG. 2, a refrigerator control method using a linear compressor according to a first embodiment of the present invention is provided. The control method comprises: monitoring an ambient temperature T of a refrigerator; comparing the ambient temperature T with a preset ambient temperature threshold T0; if T is greater than T0, controlling an output power of the linear compressor to be a preset first output power, and if T is smaller than or equal to T0, controlling the output power of the linear compressor to be a preset second output power, which is greater than the preset first output power.

Figure 3:
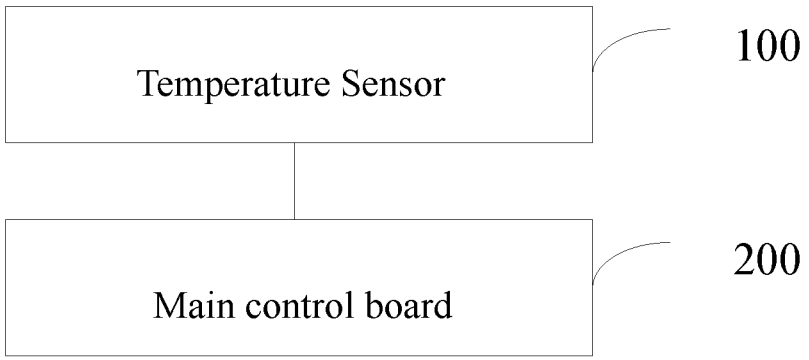
FIG. 3 is a schematic modular view of a refrigerator control system according to the first embodiment of the present invention.

Correspondingly, as shown in FIG. 3, a refrigerator control system using a linear compressor according to the present embodiment of the present invention is provided. The control system comprises a temperature sensor 100 and a main control board 200 connected with the temperature sensor 100, wherein the temperature sensor 100 is configured to monitor an ambient temperature T of a refrigerator; the main control board 200 is configured to compare the ambient temperature T with a preset ambient temperature threshold T0; and the main control board 200 is further configured to control an output power of the linear compressor, control the output power of the linear compressor to be a preset first output power if T is greater than T0, and control the output power of the linear compressor to be a preset second output power which is greater than the preset first output power if T is smaller than or equal to T0.

Preferably, the ambient temperature T in the present embodiment is acquired by a temperature sensor provided to a box body of the refrigerator or by other temperature detecting devices such as a thermometer.

The control method of the present invention is suitable for refrigerators working under low temperatures. The preset ambient temperature threshold T0 is used to define a threshold of the "low temperatures" in the present invention. For example, the preset ambient temperature threshold T0 may be set to 10° C. Then, the ambient temperatures T not greater than 10° C. ($T \leq 10°$ C.) belong to the low temperatures. Of course, 10° C. is only a preferred ambient temperature threshold, and may be set to other values in other embodiments, such as 5° C., 0° C. and the like. When the preset ambient temperature threshold T0 is set to other temperatures, the definition of the corresponding "low temperatures" will be different.

Generally, when the refrigerator works under low temperatures (or when the ambient temperature is not greater than the preset ambient temperature threshold), the thermal load of the refrigerator is relatively small, and the cooling output required by the compartments is relatively small too. Then, the linear compressor will operate at a relatively small output power. Thus, the stroke of the piston of the linear compressor is relatively small, and the piston can easily collide with the air discharging valve plate, causing failure of the mechanical members. Therefore, the frequency converting board of an existing linear compressor is usually provided with a frequency converting protection program, which will be activated when the piston collides with the air discharging valve plate to stop operation of the refrigerator. To avoid protection of the linear compressor by the frequency converting board, the operating conditions of the refrigerator need to be changed compulsorily when the refrigerator works under low temperatures.

In the present embodiment, if T is greater than T0, an output power of the linear compressor is controlled to be a preset first output power P1, and if T is smaller than or equal to T0, the output power of the linear compressor is controlled to be a preset second output power P2, which is greater than the preset first output power P1.

When the ambient temperature T is lower than the preset ambient temperature threshold T0, the thermal load of the refrigerator is relatively small, and the cooling output required by the compartments is relatively small too. Then, the linear compressor will operate at a relatively small output power. As the output power of the linear compressor is related with the stroke of the piston, the smaller the output power of the linear compressor is, the smaller the stroke of the piston will be. In the present embodiment, by increasing the stroke of the piston inside the linear compressor through increasing the output power of the linear compressor, collision between the piston and the air discharging valve plate is avoided, and the refrigerator can be guaranteed to work normally by avoiding activation of the frequency converting protection program by the frequency converting board.

It should be mentioned that as the power of the linear compressor is increased or the cooling output supplied to the compartments by the linear compressor in unit time is increased, and the cooling output required by the compartments under the first and second output powers P1, P2 is the same, when the linear compressor supplies the same cooling output, the operation period of the linear compressor under the first output power P1 is longer than that of the linear compressor under the second output power P2.

For example, in an embodiment of the present invention, it is detected that the ambient temperature T is 0° C. and the preset ambient temperature threshold T0 is 10° C. Then, the output power of the linear compressor is increased from the first output power of 20 W to the second output power of 30 W to increase the stroke of the piston inside the linear compressor.

The followings will introduce the refrigerator control method using a linear compressor according to a second embodiment of the present invention. The control method comprises: monitoring an ambient temperature T of a refrigerator; comparing the ambient temperature T with a preset ambient temperature threshold T0; if T is greater than T0, controlling an output power of the linear compressor to be a preset first output power, and if T is smaller than or equal to T0, controlling the output power of the linear compressor to be a preset second output power, which is greater than the preset first output power.

Figure 4:
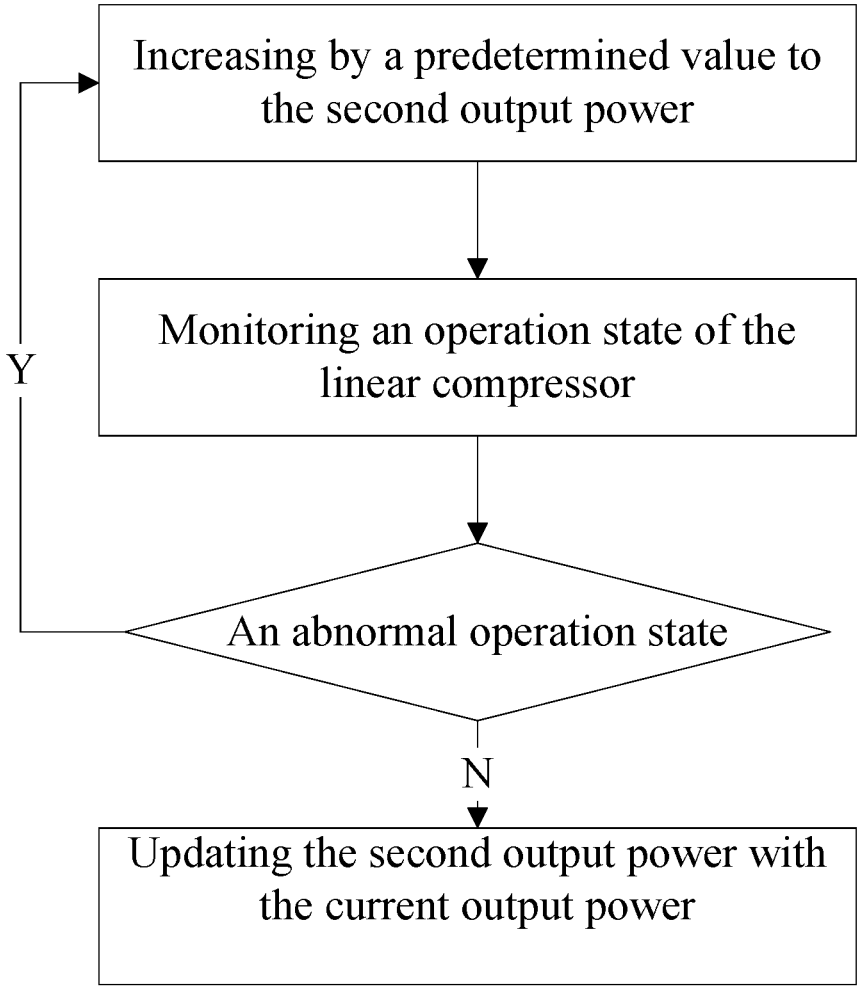
FIG. 4 is a flow chart of a refrigerator control method according to a second embodiment of the present invention.

The above steps are the same as those in the first embodiment. Further, as shown in FIG. 4, the present embodiment further comprises: monitoring an operation state of the linear compressor; when the operation state of the linear compressor is abnormal, increasing by a predetermined value to the second output power; and when the operation state of the linear compressor becomes normal, updating the second output power with the current output power.

Correspondingly, a refrigerator control system using a linear compressor according to the present embodiment of the present invention is provided. The control system comprises a temperature sensor and a main control board connected with the temperature sensor, wherein the temperature sensor is configured to monitor an ambient temperature T of a refrigerator; the main control board is configured to compare the ambient temperature T with a preset ambient temperature threshold T0; the main control board is further configured to control an output power of the linear compressor, control the output power of the linear compressor to be a preset first output power if T is greater than T0, and control the output power of the linear compressor to be a preset second output power which is greater than the preset first output power if T is smaller than or equal to T0; the main control board is further configured to monitor an operation state of the linear compressor, increase by a predetermined value to the second output power when the operation state of the linear compressor is abnormal, and update the second output power with the current output power when the operation state of the linear compressor becomes normal.

For example, in an embodiment of the present invention, it is detected that the ambient temperature T is 0° C. and the preset ambient temperature threshold T0 is 10° C. Then, the output power of the linear compressor is increased from the first output power of 20 W to the second output power of 30 W. Afterwards, an operation state of the linear compressor is monitored. When the operation state of the linear compressor is abnormal, a predetermined value of 5 W is increased to the second output power of 30 W to enable the linear compressor to operate at an output power of 35 W. When the operation state of the linear compressor becomes normal at an output power of 35 W, the second output power P2 is updated to 35 W. Afterwards, if the ambient temperature is lower than 10° C., the output power of the compressor may be increased directly from the first output power of 20 W to the updated second output power of 35 W when the compressor operates next time.

Further, when the output power of the linear compressor is increased to 35 W, the operation state of the linear compressor is monitored continuously. When the operation state of the linear compressor is abnormal, a predetermined value of 5 W is increased to the output power of the linear compressor. If the linear compressor operates normally after its output power is increased to 50 W, the second output power is updated to 50 W. Afterwards, if the ambient temperature is lower than 10° C., the output power of the compressor may be increased directly from the first output power of 20 W to the updated second output power of 50 W when the compressor operates next time. The control process of the output power of the linear compressor is dynamic and cyclic, and the second output power is dynamically updated. When the linear compressor is activated at a low temperature, it is unnecessary to increase its output power from 30 W sequentially by the predetermined value.

The followings will introduce the refrigerator control method using a linear compressor according to a third embodiment of the present invention. The control method comprises: monitoring an ambient temperature T of a refrigerator; comparing the ambient temperature T with a preset ambient temperature threshold T0; if T is greater than T0, controlling an output power of the linear compressor to be a preset first output power, and if T is smaller than or equal to T0, controlling the output power of the linear compressor to be a preset second output power, which is greater than the preset first output power.

Figure 5:
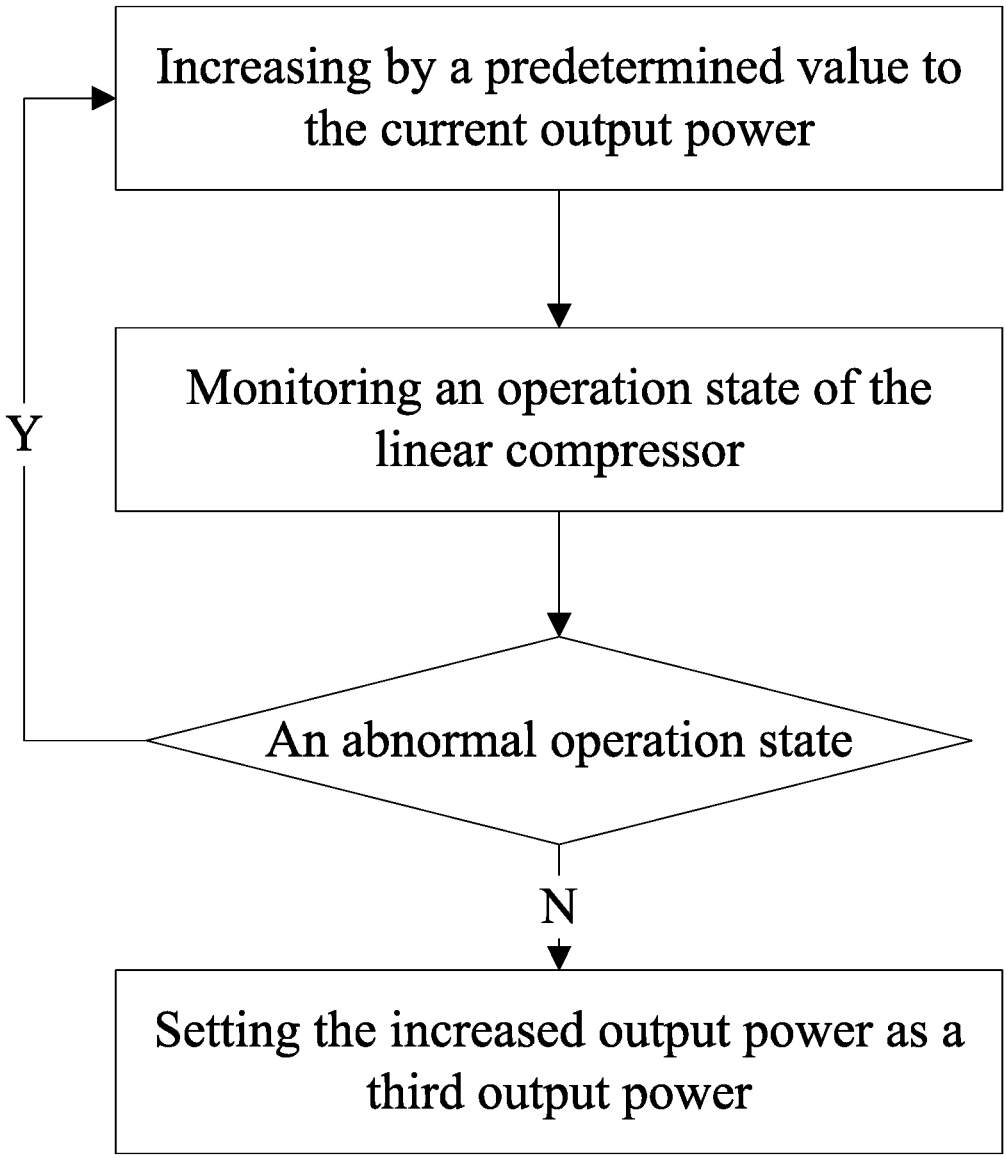
FIG. 5 is a flow chart of a refrigerator control method according to a third embodiment of the present invention.

The above steps are the same as those in the first embodiment. Further, as shown in FIG. 5, the present embodiment further comprises: monitoring an operation state of the linear compressor; when the operation state of the linear compressor is abnormal, increasing by a predetermined value to the current output power, and setting the increased output power as a third output power; when the operation state of the linear compressor becomes normal, associating the third output power with the ambient temperature T, and when the ambient temperature is smaller than or equal to T, activating the linear compressor at the third output power.

Correspondingly, a refrigerator control system using a linear compressor according to the present embodiment is provided. The control system comprises a temperature sensor and a main control board connected with the temperature sensor, wherein the temperature sensor is configured to monitor an ambient temperature T of a refrigerator; the main control board is configured to compare the ambient temperature T with a preset ambient temperature threshold T0; the main control board is further configured to control an output power of the linear compressor, control the output power of the linear compressor to be a preset first output power if T is greater than T0, and control the output power of the linear compressor to be a preset second output power which is greater than the preset first output power if T is smaller than or equal to T0; and the main control board is further configured to monitor an operation state of the linear compressor, increase by a predetermined value to the current output power and set the increased output power as a third output power when the operation state of the linear compressor is abnormal, associate the third output power with the ambient temperature T when the operation state of the linear compressor becomes normal, and activate the linear compressor at the third output power when the ambient temperature is smaller than or equal to T.

For example, in an embodiment of the present invention, it is detected that the ambient temperature T is 0° C. and the preset ambient temperature threshold T0 is 10° C. Then, the output power of the linear compressor is increased from the first output power of 20 W to the second output power of 30 W. Afterwards, an operation state of the linear compressor is monitored. When the operation state of the linear compressor is abnormal, a predetermined value of 5 W is increased to the second output power of 30 W to enable the linear compressor to operate at an output power of 35 W. At the same time, the current output power of 35 W is set as the third output power P3.

Further, when the output power of the linear compressor is increased to 35 W, the operation state of the linear compressor is monitored continuously. When the operation state of the linear compressor is abnormal, a predetermined value of 5 W is increased to the output power of the linear compressor. The output power of the linear compressor is not increased when the operation state of the linear compressor becomes normal, and the current output power is set as the third output power P3. If the linear compressor operates normally after its output power is increased to 50 W in the present embodiment, the current output power of 50 W is updated to be the third output power P3, and the current ambient temperature of 0° C. is associated with the corresponding third output power of 50 W.

After associating them, in the next operation process of the linear compressor, if it is monitored that the ambient temperature T is smaller than or equal to 0° C., the linear compressor will be activated at the third output power of 50 W; and if it is monitored that the ambient temperature T is between 0° C. and 10° C., the linear compressor will be activated at the second output power of 30 W.

In the present embodiment, the control process of the output power of the linear compressor is dynamic and cyclic, and the third output power is dynamically updated. When the linear compressor is activated at a low temperature, it is unnecessary to increase its output power from 30 W sequentially by the predetermined value.

It should be understood that although in the embodiments of the present invention, the preset first and second output powers are 20 W and 30 W respectively, and the predetermined increase value of the output power is 5 W, yet in other embodiments, the difference between the preset first and second output powers may be the same as the predetermined value. When the linear compressor is activated at a low temperature, its output power may be gradually increased by the predetermined value of 5 W from the first output power of 20 W, and the second output power may be updated in real time.

As can be seen from the above technical solutions, in the present invention, by increasing the stroke of the piston inside the linear compressor through controlling the output power of the linear compressor, the refrigerator can be guaranteed to work normally by avoiding protection of the linear compressor by the frequency converting board.

It should be understood that although the present description describes the present invention through the embodiments, each embodiment may include several technical solutions. The presentation manner of the present description only aims to make the descriptions clearer. Those skilled in the art should take the present description as an integral document. The technical solutions in the respective embodiments may be combined properly to form other embodiments which may be understood by those skilled in the art.

The above detailed descriptions are only descriptions of the feasible embodiments of the present invention, and are not intended to limit the protection scope of the present invention. Equivalent embodiments or modifications within the spirit of the present invention shall be embraced by the protection scope of the present invention.

What is claimed is:

1. A refrigerator control method using a linear compressor, comprising:

monitoring an ambient temperature T of a refrigerator;

comparing the ambient temperature T with a preset ambient temperature threshold T0;

when T is greater than T0, controlling an output power of the linear compressor to be a preset first output power, and when T is smaller than or equal to T0, controlling the output power of the linear compressor to be a preset second output power, which is greater than the preset first output power;

monitoring an operation state of the linear compressor, judging whether the linear compressor stops unexpectedly when operating within a predetermined period; when the linear compressor is judged to stop unexpectedly, regarding the operation state of the linear compressor as being in a first operation state of abnormality, otherwise, regarding the operation state of the linear compressor as being in a second operation state of normality;

when the operation state of the linear compressor is determined as being in the first operation state, increasing by a predetermined value to the second output power; and when the operation state of the linear compressor is determined as being in the second operation state, updating the second output power with a currently used output power.

2. The refrigerator control method using a linear compressor of claim 1, wherein the operation period of the linear compressor under the first output power is longer than that of the linear compressor under the second output power.

3. A refrigerator control system using a linear compressor, comprising a temperature sensor and a main control board connected with the temperature sensor, wherein:

the temperature sensor is configured to monitor an ambient temperature T of a refrigerator;

the main control board is configured to compare the ambient temperature T with a preset ambient temperature threshold T0; and the main control board is further configured to control an output power of the linear compressor, control the output power of the linear compressor to be a preset first output power when T is greater than T0, and control the output power of the linear compressor to be a preset second output power which is greater than the preset first output power when T is smaller than or equal to T0;

the main control board is further configured to monitor an operation state of the linear compressor, increase by a predetermined value to the second output power when the operation state of the linear compressor is determined by monitoring to be in a first operation state of abnormality, and update the second output power with a currently used output power when the operation state of the linear compressor is determined by monitoring to be in a second operation state of normality.

4. The refrigerator control system using a linear compressor of claim 3, wherein the main control board is further configured to: judge whether the linear compressor stops unexpectedly when operating within a predetermined period; when the linear compressor is judged to stop unexpectedly, regard the operation state of the linear compressor as being in the first operation state.

5. The refrigerator control system using a linear compressor of claim 3, wherein the main control board is further configured to control the operation period of the linear compressor under the first output power to be longer than that of the linear compressor under the second output power.

6. A refrigerator control system using a linear compressor, comprising a temperature sensor and a main control board connected with the temperature sensor, wherein:

the temperature sensor is configured to monitor an ambient temperature T of a refrigerator;

the main control board is configured to compare the ambient temperature T with a preset ambient temperature threshold T0; and the main control board is further configured to control an output power of the linear compressor, control the output power of the linear compressor to be a preset first output power when T is greater than T0, and control the output power of the linear compressor to be a preset second output power which is greater than the preset first output power when T is smaller than or equal to T0;

the main control board is further configured to monitor an operation state of the linear compressor, increase by a predetermined value to a currently used output power and set the increased output power as a third output power when the operation state of the linear compressor is determined by monitoring to be in a first operation state of abnormality, associate the third output power with the ambient temperature T when the operation state of the linear compressor is determined by monitoring to be in a second operation state of normality, and activate the linear compressor at the third output power when the ambient temperature is smaller than or equal to T.

7. The refrigerator control system using a linear compressor of claim 6, wherein the main control board is further configured to: judge whether the linear compressor stops unexpectedly when operating within a predetermined period; when the linear compressor is judged to stop unexpectedly, regard the operation state of the linear compressor as being in the first operation state.

8. The refrigerator control system using a linear compressor of claim 6, wherein the main control board is further configured to control an operation period of the linear compressor under the first output power to be longer than that of the linear compressor under the second output power.

* * * * *